US005352137A

United States Patent [19]

Iwai et al.

[11] Patent Number: 5,352,137

[45] Date of Patent: Oct. 4, 1994

[54] AUTOMATIC POSITION CONTROLLER FOR MARINE PROPULSIONS

[75] Inventors: Tomio Iwai; Ryoji Nakahama, both of Hamamatsu, Japan

[73] Assignee: Sanshin Kogyo Kabushiki Kaisha, Hamamatsu, Japan

[21] Appl. No.: 702,157

[22] Filed: May 15, 1991

Related U.S. Application Data

[63] Continuation of Ser. No. 119,097, Nov. 10, 1987, abandoned, which is a continuation-in-part of Ser. No. 864,449, May 16, 1986, abandoned.

[30] Foreign Application Priority Data

May 18, 1985 [JP] Japan ..... 60-106627

[51] Int. Cl.[5] ..... B03H 21/22

[52] U.S. Cl. ..... 440/1

[58] Field of Search ..... 440/1, 2, 50, 900, 53, 440/54, 61, 83, 84, 113; 364/424, 442; 73/178 T; 416/27; 318/588; 244/182, 191, 194; 114/275, 278, 276, 282

[56] References Cited

U.S. PATENT DOCUMENTS

| | | | |
|---|---|---|---|
| 3,070,301 | 12/1962 | Sarnoff | 364/442 |
| 3,145,003 | 8/1964 | Hart | 440/61 |
| 3,314,391 | 4/1967 | DuPont | 440/47 |
| 3,468,282 | 9/1969 | Wintercorn | 440/1 |
| 3,714,825 | 2/1973 | Melvin | 73/178 T |
| 4,089,290 | 5/1978 | Miles, Sr. et al. | 440/61 |
| 4,182,256 | 1/1980 | Scott et al. | 114/276 |
| 4,318,699 | 3/1982 | Wenstadt et al. | 440/1 |
| 4,325,700 | 4/1982 | Kern et al. | 440/61 |
| 4,482,330 | 11/1984 | Cook | 440/61 |
| 4,718,872 | 1/1988 | Olson et al. | 440/1 |

*Primary Examiner*—Edwin L. Swinehart

*Attorney, Agent, or Firm*—Knobbe, Martens, Olson & Bear

[57] ABSTRACT

Several embodiments of automatic position controls for marine propulsion devices wherein the lift condition of the propulsion device is adjusted in response to a sensed running condition of the watercraft such as changes in acceleration, speed or planing condition. In some embodiments, the trim of the propulsion unit is also adjusted in response to the sensed conditions.

23 Claims, 6 Drawing Sheets

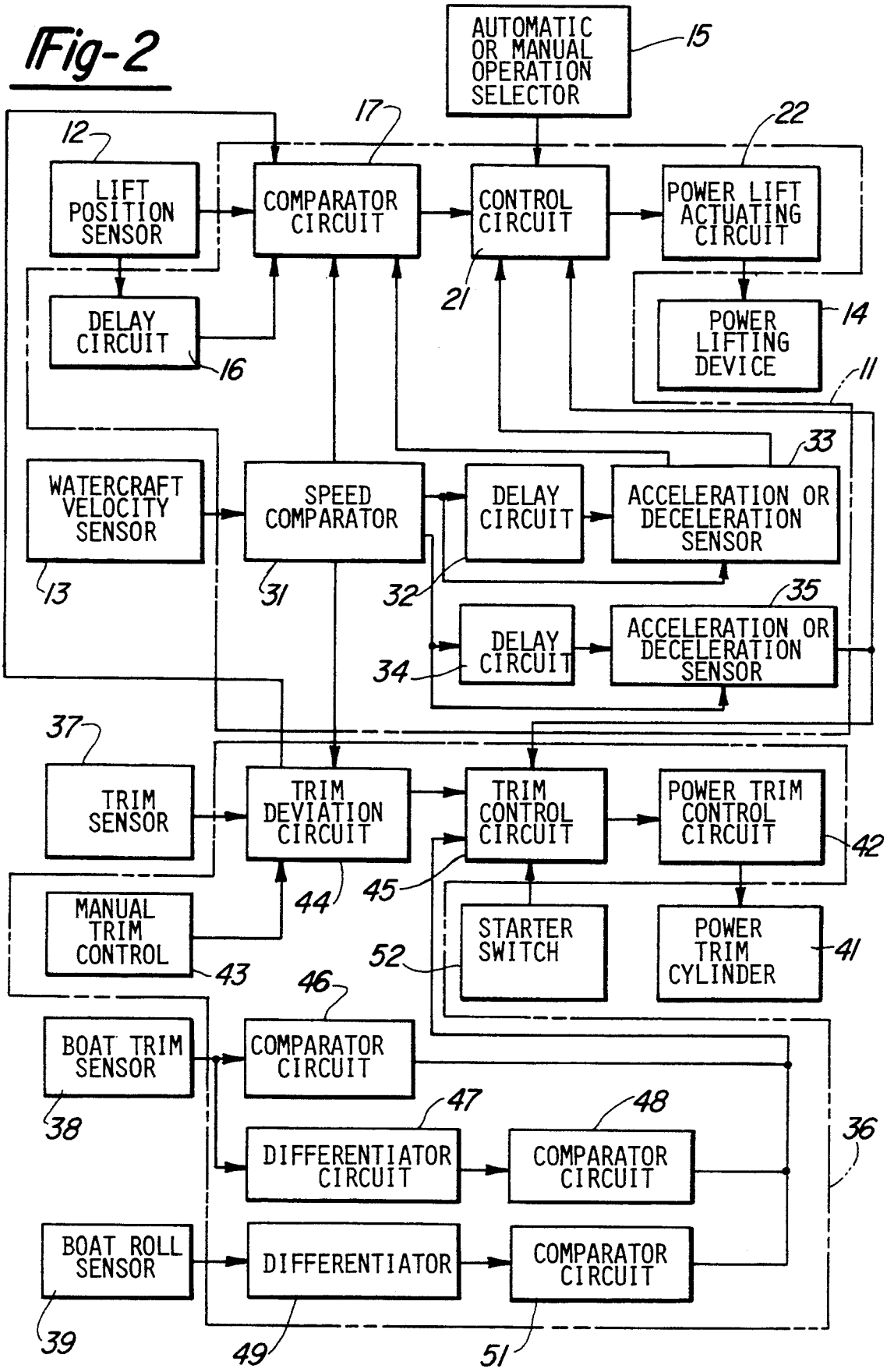
Fig-2
AUTOMATIC OR MANUAL OPERATION SELECTOR
15
12
LIFT POSITION SENSOR
17
COMPARATOR CIRCUIT
CONTROL CIRCUIT
22
POWER LIFT ACTUATING CIRCUIT
21
DELAY CIRCUIT
16
POWER LIFTING DEVICE
14
11
33
WATERCRAFT VELOCITY SENSOR
SPEED COMPARATOR
DELAY CIRCUIT
ACCELERATION OR DECELERATION SENSOR
13
31
32
35
DELAY CIRCUIT
ACCELERATION OR DECELERATION SENSOR
34
37
TRIM SENSOR
TRIM DEVIATION CIRCUIT
TRIM CONTROL CIRCUIT
POWER TRIM CONTROL CIRCUIT
42
44
45
MANUAL TRIM CONTROL
43
STARTER SWITCH
52
POWER TRIM CYLINDER
41
46
BOAT TRIM SENSOR
COMPARATOR CIRCUIT
38
47
48
DIFFERENTIATOR CIRCUIT
COMPARATOR CIRCUIT
36
BOAT ROLL SENSOR
DIFFERENTIATOR
COMPARATOR CIRCUIT
39
49
51

Fig-3
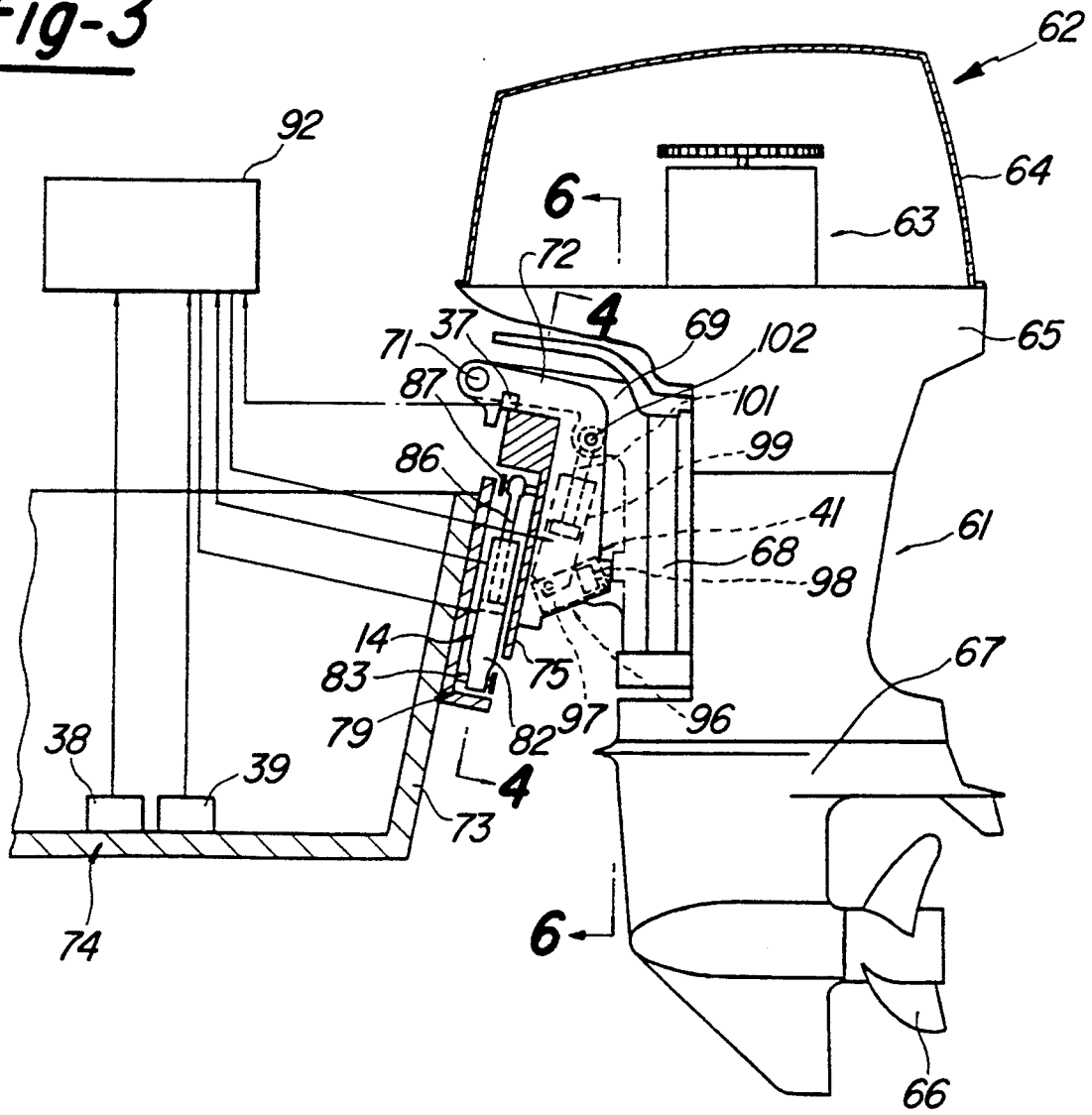
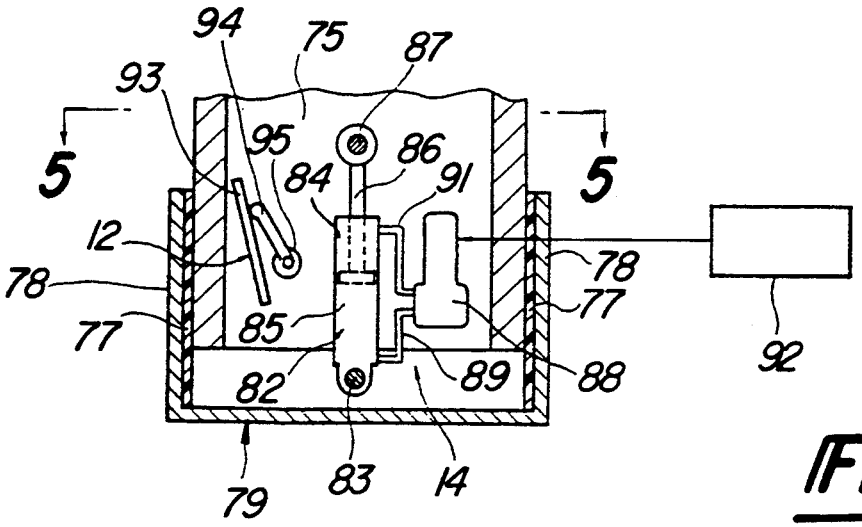
Fig-4

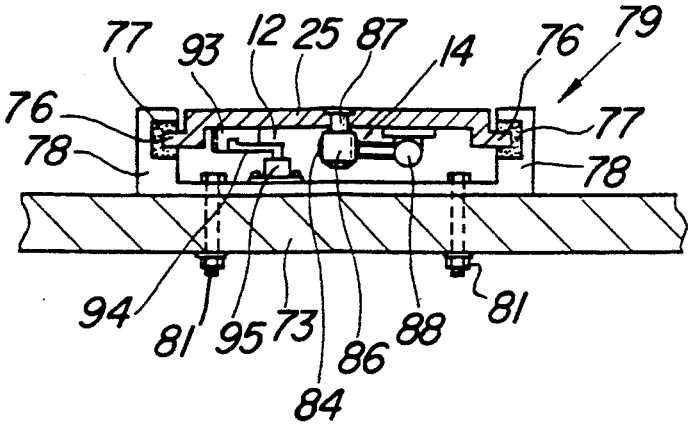
Fig-5
Fig-6
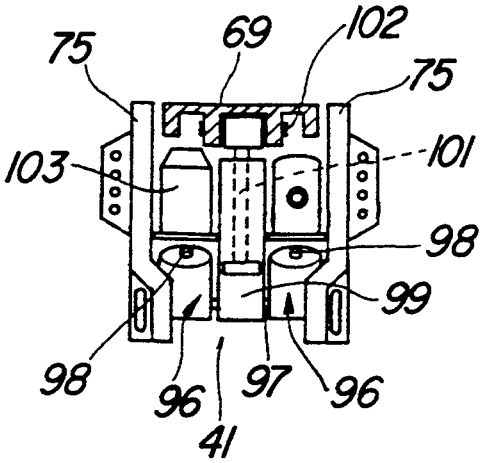

AUTOMATIC POSITION CONTROLLER FOR MARINE PROPULSIONS

CROSS REFERENCE TO RELATED APPLICATION

This is a continuation of U.S. patent application Ser. No. 119,097, filed Nov. 10, 1987, now abandoned, which is a continuation-in-part of Ser. No. 864,449, filed May 16, 1986, now abandoned.

BACKGROUND OF THE INVENTION

This invention relates to an automatic position controller for marine propulsion units and more particularly to an improved power unit for controlling the position of a marine propulsion unit and an automatic control device therefor.

It is well known to support an outboard drive such as an outboard motor or the outboard drive portion of an inboard/outboard drive on the transom of the associated watercraft for pivotal movement about a horizontally extending trim axis so as to adjust the trim of the propulsion unit. The desirable trim angle of the outboard drive varies with the watercraft running condition and such a mounting permits the outboard drive to be adjusted during operation to the optimum condition. Various types of powering devices have been employed for such trim adjustment. In addition, it is known that the vertical position of the power unit relative to the transom may be varied in order to provide the optimum relationship during different running conditions. For example, when the watercraft is accelerating, it is desirable to have the propulsion unit relatively deeply submerged. However, when the watercraft reaches a planing condition, the power unit should be elevated so that it is not so deeply submerged. Various power devices have been proposed for adjusting the degree of submersion of the outboard drive.

Clearly, the mounting of the power units for achieving trim and height adjustment present considerable problems. This is particularly true en it must be remembered that the power units are normally mounted outboard of the transom of the associated watercraft. Therefore, the power units are positioned in a location where they can easily become damaged.

It is, therefore, an object of this invention to provide an improved power unit mounting arrangement wherein the power units will be protected by their supporting structure from damage.

It is a further object of this invention to provide an improved and compact power unit arrangement for adjusting the vertical height of an outboard drive.

As has been noted, it is known that the height or vertical location of the power unit of an outboard drive should be varied under the watercraft running conditions. However, all of the power units for accomplishing vertical adjustment heretofore proposed have required manual operation. Therefore, with the prior art type of devices, it is solely within the control of the operator to select the vertical position and the operator may not be capable of sensing when the correct vertical position is reached.

It is, therefore, a further principal object of this invention to provide an improved power unit for automatically adjusting the vertical position of a marine propulsion device so as to achieve optimum running conditions.

It is a yet further objection of this invention to provide an improved control system for vertically positioning the power unit of a marine propulsion device.

It is a yet further object of this invention to provide an improved control arrangement wherein both of the vertical and trim conditions of the marine propulsion unit are controlled automatically so as to achieve optimum running conditions.

In connection with the provision of an arrangement for automatically controlling the vertical position and trim condition of a marine propulsion unit, there are certain running conditions under which it is desirable to achieve the tilt and trim adjustments in a specific sequence. For example, when accelerating from low speed, it is desirable to permit the vertical position of the outboard drive to remain relatively low in the water until the watercraft reaches a planing condition. Up until this time, the vertical position should not be changed but adjustment in the trim condition is desirable first to employ optimum acceleration and subsequently to maintain the cruising speed. Once the boat is in a planing condition, it is then desirable to raise the vertical position of the outboard drive so as to minimize water resistance of the lower unit and to improve stability.

It is, therefore, a still further object of this invention to provide an improved control arrangement wherein the trim and vertical conditions of a marine propulsion unit are controlled automatically and in the optimum relationship so as to achieve good running.

SUMMARY OF THE INVENTION

A first feature of this invention is adapted to be embodied in a power adjusting device for the mounting of an outboard drive on a transom of a watercraft comprising a transom bracket that is adapted to be affixed to the transom of a watercraft and which has a pair of spaced apart vertically extending guide members. A supporting member is supported for vertical sliding movement relative to the guide members and is adapted to receive an outboard drive for affixing the outboard drive to the transom of the watercraft. A fluid motor is affixed between the transom bracket and the supporting member for effecting vertical movement of the supporting member relative to the transom bracket upon operation of the fluid motor. The fluid motor is contained between the guide members and the supporting member for protection thereby. A fluid pump is provided for operating the fluid motor and the fluid pump is also contained between the guide members and the supporting member for its protection.

Another feature of this invention is adapted to be embodied in a marine propulsion device for a watercraft that comprises propulsion means carried by the watercraft. Means are interposed between the watercraft and the propulsion means for effecting changes in the elevation in the position of the propulsion means relative to the watercraft. Power means are provided for effecting said changes in elevation and control means are provided for operating the power means automatically to maintain the desired elevation in response to sensed watercraft conditions.

BRIEF DESCRIPTION OF THE DRAWINGS

FIG. 2 is a schematic block diagram constructed in accordance with a second embodiment of the invention.

FIG. 3 is a side elevational view, with portions shown in section and other portions shown schematically, of an outboard motor constructed in accordance with the embodiment of FIG. 2.

FIG. 4 is a cross-sectional view taken along the line 4—4 of FIG. 3.

FIG. 5 is a cross-sectional view taken along the line 5—5 of FIG. 4.

FIG. 6 is a cross-sectional view taken along the line 6—6 of FIG. 3.

DETAILED DESCRIPTION OF THE PREFERRED EMBODIMENTS

Figure 1:
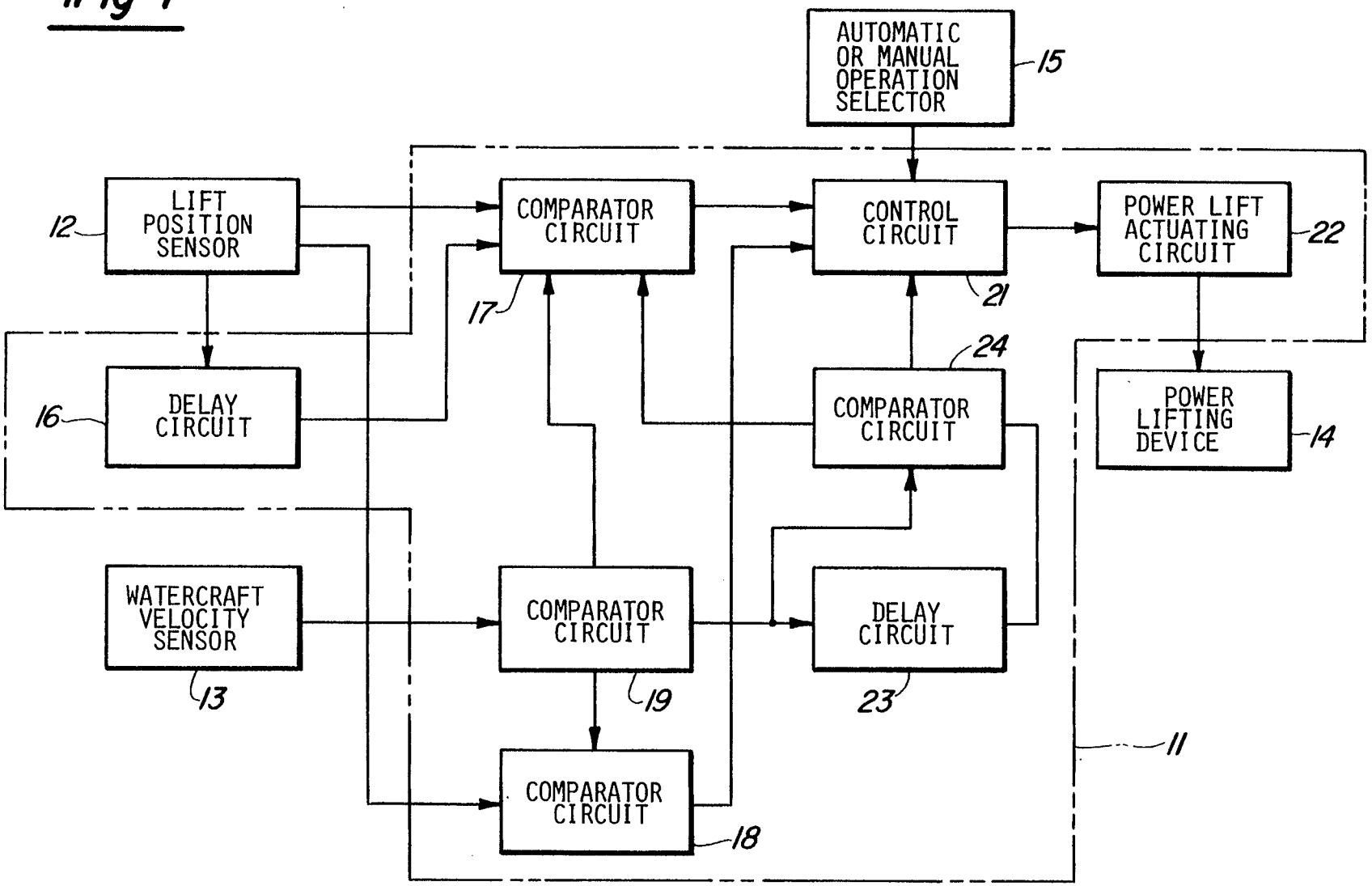
FIG. 1 is a schematic block diagram showing the construction and operation of a first embodiment of the invention.

Referring first to FIG. 1, a first embodiment of the invention is shown schematically by ay of a block diagram. Certain of the mechanical components of the embodiment of FIG. 1 are illustrated in FIGS. 3 through 6 and the construction and operation of this embodiment is believed to be readily apparent to those skilled in the art from these figures.

Referring specifically to FIG. 1, an automatic control system constructed in accordance with this embodiment is indicated generally by the dot-dash block 11. This unit 11 may comprise a central processing unit that performs certain functions, as will be noted. The central processing unit 11 functions to process control signals from a lift position sensor 12 and a watercraft velocity sensor 13 to control the operation of a power lifting device 14 which is operative to control the vertical position of an outboard drive such as an outboard motor, as will become apparent when FIGS. 3 through 6 are described. An operator positioned manual or automatic control selector switch 15 is also provided for delivering a signal to the central processing unit 11 so as to indicate whether the operator has selected manual or automatic control. In a manner to be described, the selector 15 is operative to select either automatic control or to permit the operator to manually select either raising or lowering of the outboard drive.

The central processing unit 11 includes a number of functional circuits and these include a memorizing circuit 16 that receives a signal from the lift position sensor 12 and which transmits it with a predetermined time delay to a comparator circuit 17. The comparator circuit 17 also receives an instantaneous lift position signal from the sensor 12 and compares it with the memorized signal from the circuit 16 to indicate whether the outboard drive continues to be raised. The circuit 17 determines if the outboard drive is being raised by determining if the signal from the lift position sensor 12 is greater than the previously memorized lift condition signal from the circuit 16.

The lift position signal from the lift position sensor 12 is also provided to a comparator circuit 18 which is pre-programmed to compare the lift position with the optimum lift condition as determined by the mode of operation of the associated watercraft. That is, the circuit 18 is pre-programmed to indicate the desired lift position for the outboard drive depending upon whether the watercraft is in an accelerating or cruising mode.

The CPU 11 has a circuit 19 that compares the velocity of the watercraft sensed by the sensor 13 with a pre-programmed memory that indicates the speed or velocity of the watercraft at planing condition, as preset by the data supplied by the watercraft manufacturer. If the circuit 19 determines that the watercraft is not at the planing speed, it sends a signal to this effect to the comparator circuit 18 which then outputs a signal indicating the desired position of lift of the outboard drive under acceleration. If, on the other hand, the comparator circuit 19 indicates that the watercraft is in a planing condition, this signal is transmitted to the comparator circuit 18 so that it can be determined that the proper elevation of the outboard drive is accomplished so as to provide the desired lift position of the outboard motor for such planing or cruising conditions. These lift position signals from the comparator circuit 18 are transmitted to a circuit 21 that is responsive to the manual or automatic control selector 15 so as to determine if the signal should be passed through to a control unit 22 that controls the power lifting device 14.

The comparator circuit 19 also passes through the instantaneous watercraft speed signal to a delay circuit 23 and a comparator circuit 24. The delay circuit 23 memorizes instantaneous velocity of the watercraft and transmits this signal with a preset time delay to the comparator 24. Therefore, the comparator 24 is capable of determining if instantaneous velocity is greater or less than previously sensed velocity and wi 11 provide either an acceleration or deceleration indicating output signal to the comparator circuit 17. If the comparator circuit 24 indicates that the watercraft is still accelerating, it gives a lift up signal to the circuit 17. If, on the other hand, it indicates that the watercraft is decelerating, it gives a lift down signal to the circuit 21 so as to effect lifting down of the outboard drive since the watercraft has obviously passed its planing condition and is now decelerating. If, on the other hand, the circuit 24 indicates that the watercraft is maintaining a constant speed, this assumes that the watercraft is in a planing condition and no signal is outputted to the circuit 17 or 21.

In the description, therefore, it is believed to be clear to those skilled in the art that the CPU 11 processes signals from the lifting position sensor 12 and watercraft speed sensor 13 when in its automatic mode so as to provide the optimum position for the outboard drive so that it will be deeply submerged during acceleration and will gradually be raised so that when the watercraft reaches a planing condition, the outboard drive will be raised to the desired relatively shallow submerged condition. If, on the other hand, the system is in manual mode, the operator may supply either a lifting or a lowering signal that is transmitted through the circuit 21 to the control circuit 22 for effecting either lifting or lowering of the power lifting device 14.

FIG. 2 illustrates another embodiment of the invention wherein the automatic control device is effective to provide not only lift position control for the outboard drive but also the desired trim condition and also the order in which these adjustments are effected. Certain components of the circuit for achieving the lift condition are the same or substantially the same as those of the embodiment of Figure and these components have been identified by the same reference numerals as utilized in FIG. 1. While certain of these components provide additional or slightly different functions from the previously described embodiment, these differences will be described in conjunction with this figure.

In this embodiment, the CPU 11 embodies a circuit 31 that receives the watercraft speed signal from the speed sensor 13. The circuit 31 differs from the said comparator circuit 19 of the embodiment of FIG. 1 and, for reasons which will become apparent, the CPU therefore does not employ the circuits 18, 19, 23 and 24. Rather, in this embodiment, the speed comparator circuit 31 is effective to compare actual watercraft speed indicated by the sensor 13 with a presensed speed, which may again be the planing or cruising speed of the watercraft as supplied by the watercraft manufacturer. When the speed is above the preset speed, a signal is outputted to a delay circuit 32 and a comparator circuit 33. The comparator circuit 33 also receives the direct speed signal from the comparator 31 so that it can compare the instantaneous speed with the delay speed from the delay circuit 32 and determine if there is an acceleration or deceleration condition present. If there is an acceleration condition sensed by the comparator circuit 33, the circuit 33 gives a lift up signal beck to the comparator circuit 17 to effect control of the control circuit 22 for operating the lifting device 14 in a lifting condition when the circuit 21 indicates the device is in an automatic mode. If, on the other hand, it is determined that the watercraft is decelerating but the watercraft is sensed to be planing, the comparator circuit 33 provides a control signal to the circuit 21 which, if operating in an automatic mode, operates the control device 22 for actuating the lifting device 14 in a lifting down direction overriding any lift up signal otherwise present. If the comparator 33 indicates that there is no variation in speed, it gives no output signal so as to provide no control of the lifting device 14 and thus functions like the circuit 24 of the embodiment of FIG. 1.

In connection with this embodiment, a CPU 11 operates so as to delay the function of the lifting device 14 when the speed of the watercraft is below a predetermined s-cd and the watercraft is accelerating. The reason for this is that when the watercraft is accelerating but is not in a planing condition, it is desirable to delay the lifting operation until the watercraft actually reaches its planing condition. This will insure that the propeller is fully submerged during the acceleration so that maximum acceleration will be obtained. However, once the watercraft reaches its planing condition, the lifting operations is achieved in the manner aforedescribed so as to reduce the water resistance of the lower unit and to permit the propeller to reach high RPMs by raising at least a portion of it out of the water. The trim adjustment is achieved in a manner as will be described below.

If the speed comparator 31 indicates that the actual watercraft speed is below the preset speed, it outputs a signal to a delay circuit 34 and this same signal to a comparator circuit 35. The comparator circuit 35 compares instantaneous watercraft s with watercraft speed at a previous time, as sent by the delay circuit 34 and determines if there is an acceleration or deceleration condition. If it is determined that there is a deceleration, there is a signal outputted to the control circuit 21 for effecting lifting down of the outboard drive when in an automatic mode. This is effective to lift down the outboard drive in anticipation of the watercraft being stopped so that the outboard drive will be in a lowered position for the next starting and acceleration of the watercraft.

As has been noted, this embodiment also provides an arrangement for effecting automatic trim control of the outboard drive and, for this purpose, there is provided a further CPU, indicated by the block 36. This CPU receives inputs from a trim position sensor 37, a boat trim angle sensor 38 and a boat roll sensor 39. The boat trim angle sensor 38 indicates whether the boat is in a planing condition by determining the angle of the hull relative to the body of water in which the watercraft is operating. The CPU 36 is operative to control a power trim device 41, which is associated with the outboard drive in a manner as will become apparent in connection with the FIGS. 3 through 6. The CPU 36 includes a trim control device 42 that is operative to provide the control for the power trim device 41 for driving it in a trim up or trim down condition.

The CPU 36 controls the power trim device in the following manner. If the watercraft is accelerating from rest, the CPU causes the trim angle to be adjusted through a negative range so as to provide maximum thrust for acceleration. As has been previously noted, during this phase of the operation the system is such so as to maintain the lift of the outboard drive in a generally fully down condition. As the acceleration continues, the trim angle of the outboard drive is then adjusted to a positive angle as the watercraft reaches its planing condition. Once the watercraft is in the planing condition, the lift circuit is then activated so as to permit lifting of the outboard drive to the desired position, in a manner as aforenoted. This subsequent lifting of the outboard drive insures minimum flow resistance and also raises the propeller slightly out of the water so as to permit it to achieve maximum RPMs.

The manual trim set control unit 43 is provided that will permit the operator to set the desired trim angle rather than using a pre-programmed desired trim angle set directly into the CPU 36.

The CPU 36 includes a comparator and control circuit 44 that receives input signals from the trim sensor 37 and the manual trim control 43, if manual control is applied. In addition, the comparator circuit 31 of the CPU 11 is operative to provide an output signal to cause trim up if the speed of the watercraft is determined to be above the preset speed so as to provide the desired trim angle under this (planing) condition. Under this condition or if the comparator indicates that the manual control 43 calls for trim up, there will be outputted a signal to a circuit 45 that provides a trim up control to the power trim control 42 for effecting trim up. If this condition exists, the circuit 45 also outputs a signal to the lift circuit 17 so as to transmit a lift signal to the lift device 14 through the circuits 21 and 22 for a brief period of time. The signal overrides the normal lift signal under the planing condition.

In addition, the CPU includes a comparator circuit 46 that receives the boat trim angle signal from the sensor 38 and compares it with the preset angle indicative of the planing condition to determine if the boat is planing or not. If so, it gives a trim down signal to the trim control circuit 45 that effects trimming down through the power trim control 42.

The CPU 36 also includes a differentiating circuit 47 that differentiates the sensed boat trim angle and sends this differential signal to a rate of change circuit 48 that determines if trimming down is required and if so it gives a trim down signal to the trim control 45 for effecting trim down of the power unit 41.

The device also includes an arrangement for determining if there is a boat rolling condition and will effect trimming down so as to stabilize rolling. For this purpose, the boat roll sensor 39 provides an output signal to a differentiating circuit 49 which, in turn, determines the rate of change of the roll and provides an output to a circuit 51 which will effect control of the trim control circuit 45 to provide trimming down in the event that there is excessive rolling.

It should be noted that the trim control 45 also receives a signal from the circuit 35 so as to achieve trimming down in the event that the output of the circuit 35 indicates that lift down and trim down are required.

The system further includes a starting control switch 52 in the event that the electric motor for driving the hydraulic pump also functions as a starter motor so as to disable the trim and lifting functions during starting operation. The control switch 52 also functions so as to permit manual trim adjustment if the operator so selects.

Referring now in detail to FIGS. 3 through 6, an actual physical embodiment of the construction shown in FIG. 2 is illustrated and will be described. It will also be explained how, with minor modification, this structure can be employed in conjunction with the logic of the embodiment of FIG. 1.

In FIG. 3, an outboard motor is illustrated generally by the reference numeral 61. Although the invention is described in conjunction with an outboard motor, it is to be understood that it may equally as well be practiced with the outboard drive section of an inboard/outboard drive. However, the invention has particular utility with an outboard motor that is adapted to be detachably mounted to the transom of a watercraft.

The outboard motor 61 includes a power head, indicated generally by the reference numeral 62 and which includes an internal combustion engine 63, of any known type, and a surrounding protective cowling 64. A drive shaft housing 65 depends from the power head 62 and contains a drive shaft (not shown) that is driven by the engine 63 and which drives a propeller 66 carried by a lower unit 67 through a forward, reverse transmission (not shown).

A steering shaft 68 is affixed, in a suitable manner, to the drive shaft housing 65 and is journaled for steering movement about a vertically extending steering axis within a swivel bracket 69. The swivel bracket 69 is, in turn, supported for pivotal movement about a horizontally extending axis by means of a tilt pin 71 and clamping bracket 72. The clamping bracket 72 of the outboard motor normally carries an arrangement for detachably affixing it to a transom 73 of the hull of an associated watercraft, illustrated partially and indicated generally by the reference numeral 74. In accordance with the invention, however, the clamping bracket 72 is adapted to be detachably affixed to a supporting bracket 75 which is supported for vertical movement relative to the transom 73, so as to adjust the height or lift of the propeller 66. As may be readily seen in FIG. 5, the supporting bracket 75 has a pair of outwardly extending flanges 76 that are slidably supported in ways 77 formed in a pair of vertically extending guide members 78 of a transom bracket, indicated generally by the reference numeral 79. The transom bracket 79 is affixed in a suitable manner to the transom 73, as by means of threaded fasteners 81.

The lifting device 14 is interposed between the transom bracket 79 and the supporting bracket 75 for effecting the lifting movement of the outboard motor 61. In the illustrated embodiment, the lifting device 14 comprises a fluid motor consisting of a cylinder housing 82 that has a trunnion at its lower end which is pivotally connected to the transom bracket 79 by means of a pin 83. The cylinder 82 has an internal bore in which a piston is slidable so as to divide the bore into an upper chamber 84 and a lower chamber 85. The piston carries a piston red 86 which extends through the upper end of the cylinder 82 and which is pivotally connected to the supporting bracket 75 by means of a pivot pin 87.

A reversible fluid pump 88 is provided for selectively pressurizing either a conduit 89 to pressurize the fluid motor chamber 86 to effect lifting or a line 91 to pressurize the fluid motor chamber 84 to provide lowering. The fluid pump 88 is driven by a reversible electric motor under the control of the control device, indicated generally by the reference numeral 92 and which may comprise the control circuit of FIG. 2 or that of FIG. 1. In the illustrated embodiment, however, the control circuit A is depicted as being operative to function in accordance with the block diagram shown in FIG. 2.

It should be noted that the lifting device 14 including the cylinder 82 and powering reversible fluid pump 88 and its driving motor are all positioned between the vertically extending guide members 78 of the transom bracket 79 and between the transom bracket 79 and the supporting bracket 75 so that, even though they are mounted outboard of the transom 73, they will be well protected.

The lift position sensor 12 is also provided in this area and thus is protected. The lift position sensor 12 includes an indicator plate 93 that is inclined to the vertical and which is affixed to or formed integrally with the supporting bracket 75. The indicator plate 93 is engaged by a wiper arm 94 of a rotary potentiometer 95 so that the arm 94 will be rotated upon vertical movement and provide a change in resistance of the potentiometer 95 that may be utilized to provide the lift position signal, as will be readily apparent to those skilled in this art.

The power trim device 41 is best illustrated in FIGS. 3 and 4 and includes a pair of trim cylinders 96 that have their housing assemblies 97 affixed to the clamping bracket 72. Cylinders 97 are divided into upper and lower internal chambers by respective pistons that have piston reds 98 that extend through the cylinder housing and which engage the swivel bracket 69 for effecting pivotal movement of it about the pivot pin 71 upon movement of the piston rod 98 within the cylinders 97, in a manner well known in this art.

In addition, there is provided a tilt cylinder assembly 99 that is pivotally connected at one end to the clamping bracket 72. A piston is supported within the tilt cylinder assembly 99 and has a piston rod 101 that is connected to the swivel bracket 69 by means of a pivot pin 102. An appropriate hydraulic circuit of any known type, including a reversible fluid pump 103 is provided for operating the tilt cylinder assembly 99 and the trim cylinder assemblies 96 in a manner known in this art so as to accomplish trim adjustment and also so as to permit select tilting up of the outboard motor 61.

It should be noted that the reversible hydraulic pump 103, trim cylinder assemblies 96 and tilt cylinder assembly 99 are positioned between the clamping bracket 72, supporting bracket 75 and swivel bracket 69 so that these components will be well protected even though they are mounted in an outboard position.

In FIG. 3, the trim position sensor 38, roll sensor 39 and trim condition sensor 37 are all illustrated schematically as well as their respective connections to the controller 92 and the connections between the controller 92 and the actuated components. However, reference may be had to FIG. 2 for a more detailed understanding of how the control is interrelated to the various elements.

Although the embodiment of FIGS. 3 through 6 shows the relationship between the trim and lift cylinder assemblies, it is to be understood that the general construction may also be embodied in conjunction with a system that operates according to the embodiment of FIG. 1 wherein the lift only is automatically controlled and wherein the trim is accomplished by a pure manual adjustment.

Figure 7:
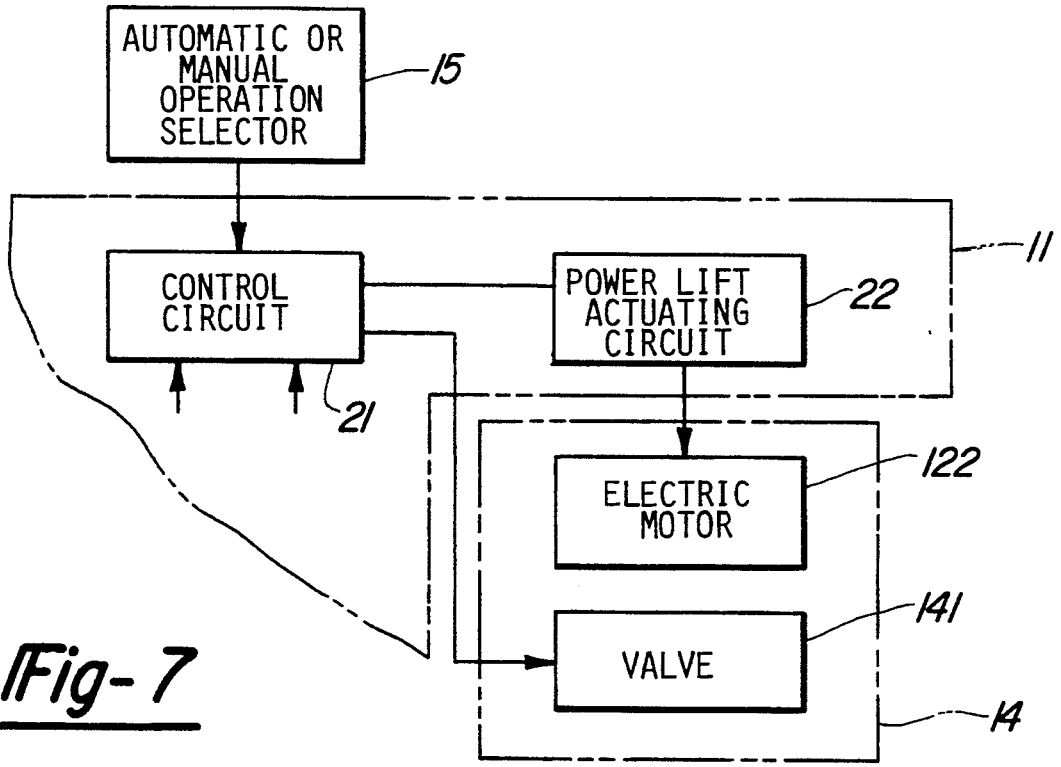
FIG. 7 is a schematic view showing the construction of a portion of a still further embodiment of the invention.
Figure 8:
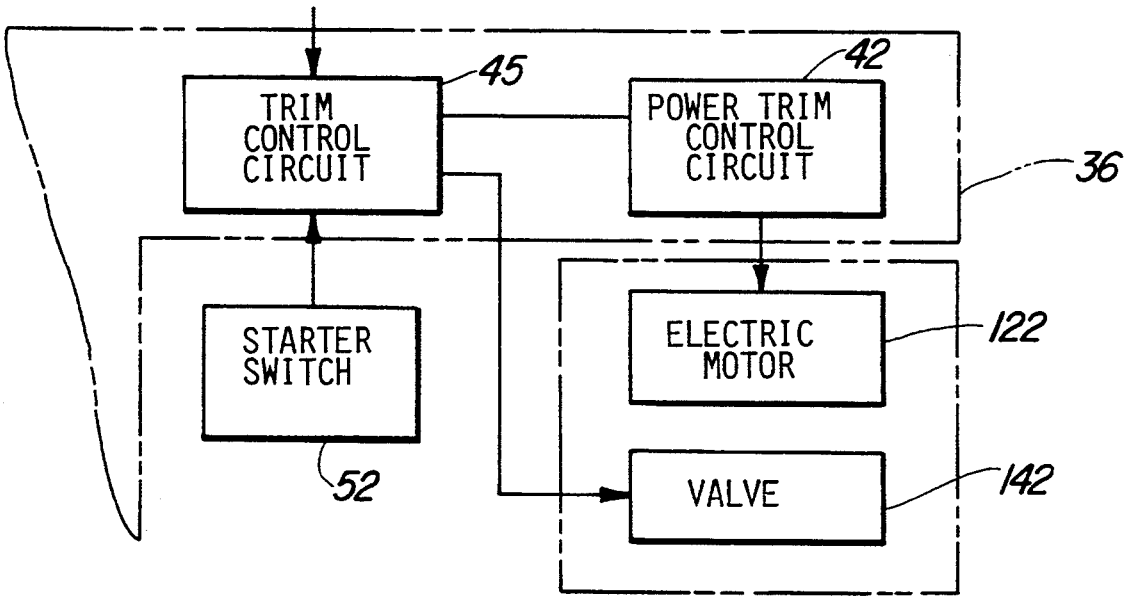
FIG. 8 is a schematic view, of another portion of the embodiment of FIG. 7.
Figure 9:
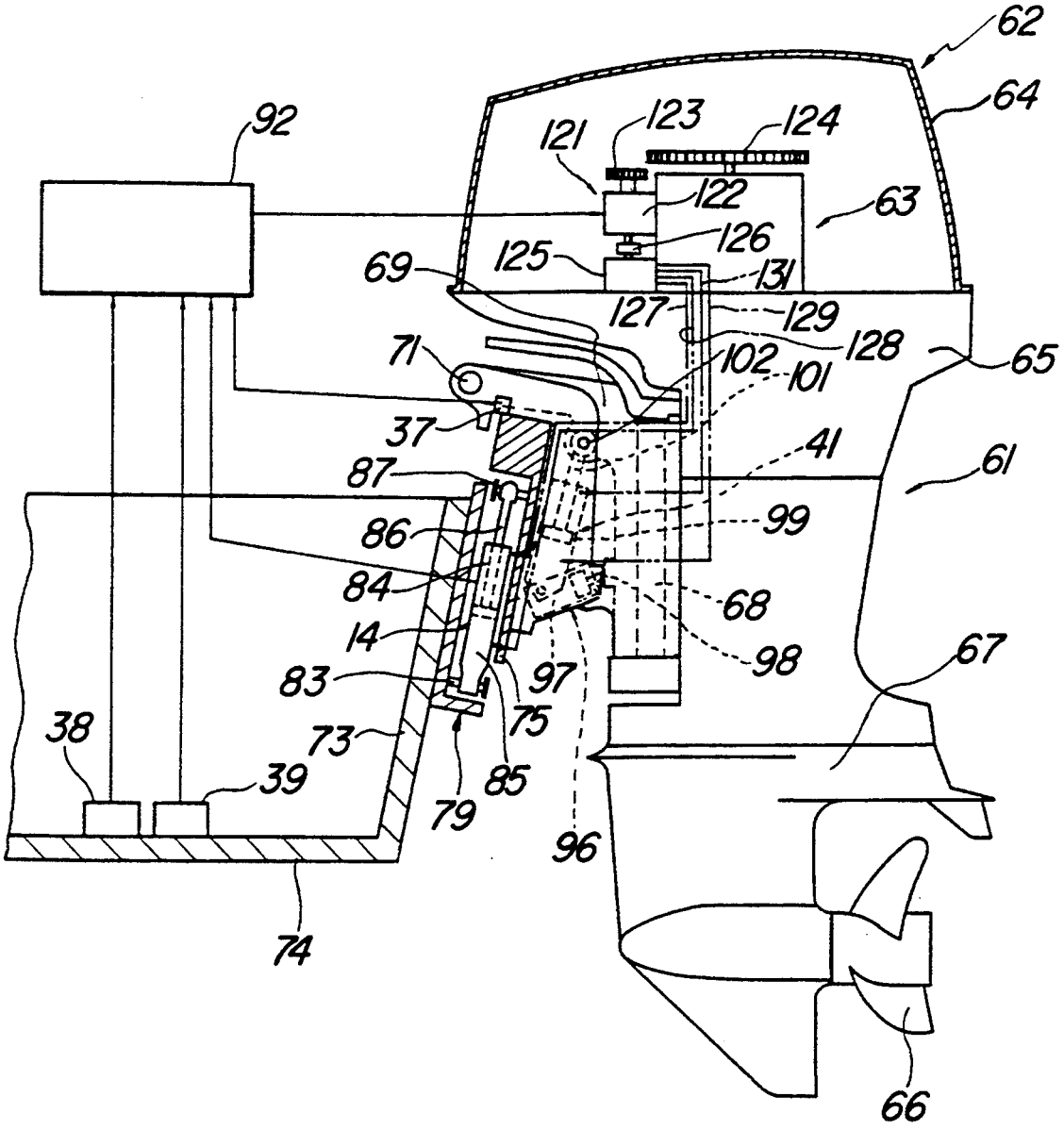
FIG. 9 is a side elevational view with portions shown in section, in part similar to FIG. 3, showing the mechanical elements of the embodiment of FIGS. 7 and 8.

In the embodiments as thus far shown and described, the lift and trim cylinders are each operated by respective reversible fluid pumps which are, in turn, driven selectively by independent reversible electric motors. FIGS. 7 through 9 show another embodiment of the invention wherein the fluid motors are operated by means of a fluid pump that is driven by the starter motor of the outboard motor. In these embodiments, the starter motor is employed for both electric starting of the outboard motor and for driving a one-way fluid pump which controls the fluid motors through directional control valves.

Referring first to FIG. 9, the basic construction of the outboard motor, lifting device and trim devices is the same as the preceding embodiments. For that reason, these components have been identified by the same reference numerals and will not be described again in detail. In this embodiment, an electric motor starter mechanism 121 including a reversible electric motor 122 is carried by the engine 63. The starter mechanism includes a starter gear 123 that is adapted to engage a starter gear 124 carried by the flywheel of the engine 63 for starting the engine when the electric motor 122 is driven in a first direction.

An input element of a fluid pump 125 is coupled to the shaft of the starter motor 122 through a one-way clutch 126. The one-way clutch is operative to provide rotation of the fluid pump 125 when the starter motor is driven in a direction reversed to its normal starting direction and which is operative to preclude driving of the fluid pump 125 when the starter motor 122 is rotated in the direction to accomplish engine starting.

The fluid pump 125 further includes a directional control valve which is connected to the lift mechanism 14 by means of a lift up line 127 and a lift down line 128 so as to selectively accomplish either lifting or lowering of the outboard motor 61 depending upon how the directional control valve is operated. In addition, a directional control valve selectively connects the fluid pump to a trim up line 129 or a trim down line 131 for selectively effecting trim up or trim down of the outboard motor. Hence, this embodiment operates so as to achieve trim up and trim down and lift up and lift down from a single electric motor driven one-way fluid pump through a series of directional control valves.

FIGS. 7 and 8 show schematically how this system operates. In these figures, the lift device 14 is depicted as including the electric starter motor 122 and a directional control valve 141 for selectively effecting either lifting or lowering operation depending upon the signals received from the control device 21.

In FIG. 8, the relationship is shown to the trim arrangement, indicated generally by the reference numeral 41, and including a directional control valve 142 for selectively effecting either trim up or trim down operation under the influence of the control 45.

A number of embodiments of the invention have been illustrated and described and it is believed from those descriptions that various changes and modifications may be made without departing from the spirit and scope of the invention as defined by the appended claims.

We claim

1. A marine propulsion device for a watercraft comprising an outboard drive carried by the watercraft, means for supporting said outboard drive for changes in the elevation of the position of said outboard drive relative to the watercraft independently of the trim of the outboard drive, power means for effecting said changes in elevation, sensing means for sensing a watercraft running condition and control means for operating said power means automatically to change the elevation of said outboard drive independently of the trim in response to the output of said sensing means.

2. A device as set forth in claim 1 wherein the outboard drive is carried on a transom of a watercraft by means comprising a transom bracket adapted to be affixed to the transom of a watercraft and having a pair of spaced apart, generally vertically extending guide members, a supporting bracket supported for vertical sliding movement by said guide members and adapted to receive an outboard drive for affixing the outboard drive to the transom of the watercraft the power means comprising a fluid motor affixed between said transom bracket and said supporting bracket for effecting vertical movement of said supporting bracket relative to said transom bracket upon operation of said fluid motor, said fluid motor being contained between said guide members and said supporting member for protection thereby, and a fluid pump for operating said fluid motor, said fluid pump being contained between said guide members and said supporting bracket for protection thereby and being operated by the control means.

3. A device as set forth in claim 2 further including a reversible electric motor for driving said fluid pump and positioned between and protected by said guide members and said supporting bracket.

4. A device as set forth in claim 2 further including a lift position indicator interposed between the transom bracket and the supporting member and positioned between the guide members and the supporting member for protection thereby and for supplying an elevation condition signal to the control means.

5. A device as set forth in claim 4 wherein the lift position indicator includes a lift indicating member affixed to one of the brackets and a rotary potentiometer having a wiper arm engaged with said lift position indicator carried by the other of said brackets.

6. A device as set for in claim 2 further including means for supporting the outboard drive for trim adjustment about a horizontally extending trim axis upon the supporting bracket.

7. A power adjusting device as set forth in claim 6 further including common control means for automatically controlling the trim position of the outboard drive and the lift position thereof.

8. A power adjusting device as set forth in claim 6 wherein there is provided a trim fluid motor operatively interposed between the outboard drive and the supporting member for controlling the trim position of the outboard drive, said trim fluid motor being positioned between the supporting member and the outboard drive and protected thereby.

9. A device as set forth in claim 1 wherein the sensed condition comprises acceleration.

10. A device as set forth in claim 1 wherein the sensed condition comprises speed of the watercraft.

11. A device as set forth in claim 1 wherein the sensed condition comprises planing of the watercraft.

12. A device as set forth in claim 1 further including means for automatically adjusting the trim of the outboard drive in response to a sensed condition of the watercraft.

13. A device as set forth in claim 12 wherein the trim is adjusted prior to adjustment of the elevation.

14. A device as set for in claim 12 wherein the sensed condition for trim adjustment comprises acceleration.

15. A device as set forth in claim 12 wherein the sensed condition for the trim adjustment comprises speed of the watercraft.

16. A device as set forth in claim 12 wherein the sensed condition for the trim adjustment comprises planing of the watercraft.

17. A system for optimizing the operating of an engine driven marine drive unit for a boat comprising: means for trimming the drive unit relative to the boat; means for moving the drive unit vertically relative to the boat; means for sensing the trim position of the drive unit with respect to the boat and for generating an output signal representative of the drive unit rim position; means for sensing the vertical position of the drive unit with respect to the boat and for generating an output signal representative of the drive unit vertical position; and control means operative to receive and store said output signals, said control means being responsive to a selected input signal to cause the trimming means and the moving means to move the drive unit to a position based on stored output signals.

18. The system as set forth in claim 17 wherein said means for trimming and said means for moving the drive unit comprises, respectively, a separately operable trim system and a separately operable lift system.

19. The system as set forth in claim 18 wherein said control means is operative to receive and store drive unit position output signals selectively representative of an acceleration position and a cruising position.

20. The system as set forth in claim 19 wherein the storage of said drive unit position output signals is preprogrammed.

21. The system as set forth in claim 20 including means for sensing boat speed and for generating an output signal indicative of boat speed.

22. The system as set forth in claim 21 wherein said control means is operative in response to said boat speed output signal to control operation of said trim system and said lift system.

23. The system as set forth in claim 22 wherein said control means is operative to effect sequential operation of said lift and trim systems.

* * * * *